US009316047B2

(12) United States Patent
Balay et al.

(10) Patent No.: US 9,316,047 B2
(45) Date of Patent: Apr. 19, 2016

(54) CLOSURE CURTAIN WITH BUMPER CENTERING DEVICE

(75) Inventors: Tom Balay, Drums, PA (US); Brian Reklaitis, Pittston, PA (US)

(73) Assignee: CIW Enterprises, Inc., Mountaintop, PA (US)

( * ) Notice: Subject to any disclaimer, the term of this patent is extended or adjusted under 35 U.S.C. 154(b) by 0 days.

(21) Appl. No.: 13/554,191

(22) Filed: Jul. 20, 2012

(65) Prior Publication Data

US 2014/0020853 A1 Jan. 23, 2014

(51) Int. Cl.

| | |
|---|---|
| ***A47G 5/02*** | (2006.01) |
| ***E06B 9/56*** | (2006.01) |
| ***E06B 9/08*** | (2006.01) |
| ***E06B 9/62*** | (2006.01) |
| ***E06B 9/58*** | (2006.01) |
| *E06B 9/15* | (2006.01) |
| *E06B 9/17* | (2006.01) |
| *E06B 9/18* | (2006.01) |
| *E06B 9/60* | (2006.01) |
| *E06B 9/80* | (2006.01) |

(52) U.S. Cl.

CPC . *E06B 9/08* (2013.01); *E06B 9/582* (2013.01); *E06B 9/62* (2013.01); *E06B 9/15* (2013.01); *E06B 9/17046* (2013.01); *E06B 9/18* (2013.01); *E06B 9/60* (2013.01); *E06B 2009/801* (2013.01)

(58) Field of Classification Search

CPC ..... E06B 3/12; E06B 9/08; E06B 9/11; E06B 9/15; E06B 9/18

USPC ..... 160/232, 235, 236, 266, 269, 270, 271, 160/267.1, 268.1, 272, 273.1, 133

See application file for complete search history.

(56) References Cited

U.S. PATENT DOCUMENTS

| | | | | |
|---|---|---|---|---|
| 1,127,459 | A | | 2/1915 | Laun |
| 2,037,458 | A | * | 4/1936 | Cornell et al. ..... 160/133 |
| 2,564,545 | A | | 8/1951 | Rochford |
| 2,940,520 | A | * | 6/1960 | Cookson, Jr. et al. ..... 160/229.1 |
| 3,044,540 | A | | 7/1962 | Hammersley |
| 3,166,306 | A | | 1/1965 | Peltier |
| 3,490,514 | A | * | 1/1970 | Stallings et al. ..... 160/23.1 |
| 3,601,175 | A | * | 8/1971 | Wardlaw ..... 160/213 |
| 4,282,920 | A | * | 8/1981 | Kremm ..... 160/133 |
| 4,343,340 | A | * | 8/1982 | Paule ..... 160/232 |
| 5,246,054 | A | * | 9/1993 | Shepherd et al. ..... 160/133 |
| 5,865,235 | A | | 2/1999 | Krupke |
| 5,882,053 | A | | 3/1999 | Bekins et al. |
| 6,081,966 | A | | 7/2000 | Antekeier et al. |
| 6,185,783 | B1 | | 2/2001 | Carpinella |

(Continued)

OTHER PUBLICATIONS

Coefficient of Friciton table. Acessed from http://www.tribology-abc.com/abc/cof.htm on Oct. 16, 2013.*

(Continued)

*Primary Examiner* — Syed A Islam
*Assistant Examiner* — Jeremy Ramsey
(74) *Attorney, Agent, or Firm* — Mitchell A. Smolow

(57) ABSTRACT

An overhead vertical closure, such as an overhead coiling door is described. A plurality of bumpers are spaced and fixed along the sides of the closure to center the curtain between the support brackets. In a first preferred embodiment, the geometry of the bumper is such that the vertical side and the extending sides meet in one or more obtuse angles. In a second preferred embodiment, the geometry of the bumper is such that the vertical side and the extending sides meet in a radius.

20 Claims, 2 Drawing Sheets

(56) References Cited

U.S. PATENT DOCUMENTS

| | | | | |
|---|---|---|---|---|
| 6,554,047 | B1 | 4/2003 | Mondragon et al. | |
| 6,598,929 | B2 | 7/2003 | Schlecht et al. | |
| 6,843,300 | B2 | 1/2005 | Mullet et al. | |
| 6,923,237 | B2 | 8/2005 | Workman et al. | |
| 6,951,236 | B2 * | 10/2005 | Schlater et al. | 160/133 |
| 7,409,980 | B1 * | 8/2008 | Heissenberg | 160/133 |
| 7,934,533 | B2 | 5/2011 | Walter et al. | |
| 7,978,345 | B2 | 7/2011 | Baynard et al. | |
| 8,112,939 | B2 | 2/2012 | Miller et al. | |

OTHER PUBLICATIONS

Poly-Tech Industrial, Inc, UHWM (Ultra High Molecular Weight Polyethylene), copyright 2011, accessed Mar. 2, 2015 at http://www.polytechindustrial.com/products/plastic-stock-shapes/uhmw-polyethylene.*

* cited by examiner

CLOSURE CURTAIN WITH BUMPER CENTERING DEVICE

FIELD OF THE INVENTION

This invention relates generally to closure curtains and in particular, to a closure curtain with a bumper centering device.

BACKGROUND OF THE INVENTION

Access openings, such as entranceways, doorways, hallways, and areas above countertops are often secured by overhead (vertically traveling) closures.

Rolling steel doors, also referred to as overhead coiling closures, are metal slatted doors which move in a generally vertical path, coiling above the opening as the door is opened. Because rolling steel doors have many fewer parts than sectional doors with less risk for damage and inoperability, they often make a better solution for facilities that cannot afford opening downtime.

Rolling grilles also coil above the opening and provide access control and off hour security on interior and exterior openings, but unlike rolling steel doors simultaneously permit visual access of separated spaces. Grilles prevent unauthorized access and discourage forced entry at building exterior openings, storefronts or areas within buildings, such as pharmacies or parts counters. Used behind plate glass storefronts, they are a deterrent to smash-and-grab crime.

Rolling counter fire doors, also referred to as fire shutters, coil above the opening and are used to secure openings above counters and other similar finished openings on interior and exterior walls. When the compact components of counter fire doors are desired, these units can fully close to the floor.

All of the aforementioned overhead coiling door designs travel within a pair of tracks positioned on either side of the opening. Usually rollers are not utilized. Because there are no rollers extending from the sides of the curtain, the curtain can have a tendency to move off center as it is being raised or lowered. Off center operation increases the likelihood that operative movement will not be smooth, and in extreme circumstances jamming can occur.

Accordingly, there is still a continuing need for improved curtain centering designs. The present invention fulfills this need and further provides related advantages.

BRIEF SUMMARY OF THE INVENTION

In a preferred embodiment, a plurality of bumpers are spaced and fixed along the sides of the closure curtain of an overhead closure. In a first preferred embodiment, the geometry of the bumper is such that the vertical side and the extending sides meet in one or more obtuse angles.

In a second preferred embodiment, the geometry of the bumper is such that the vertical side and the extending sides meet in a radius.

One advantage of the novel technology is that the closure curtain remains centered to prevent jamming.

Another advantage of the novel technology is that smooth travel of the closure curtain within the tracks is maintained.

Yet another advantage is that the novel technology reduces wear on the coil brackets, the ends of the curtain and other component parts.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
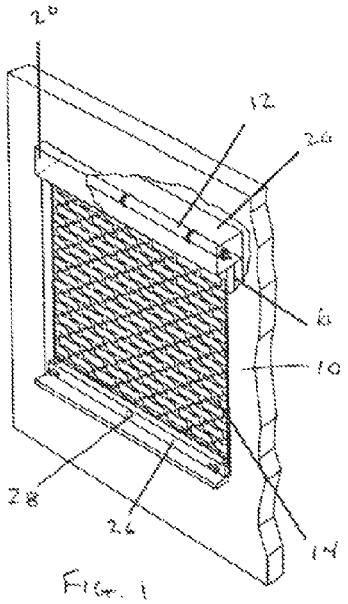
FIG. 1 is a perspective view of a shutter in the form of a rolling grille.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

Figure 2:
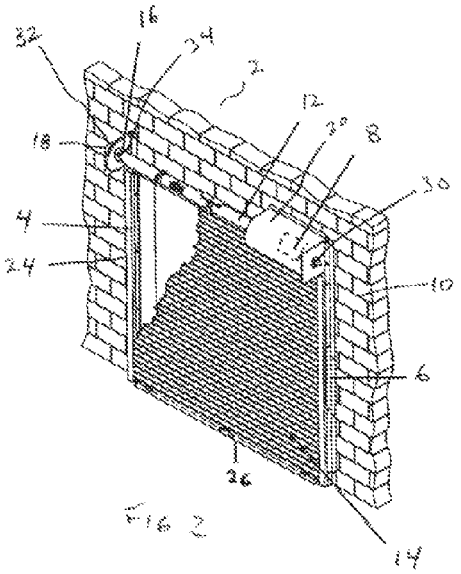
FIG. 2 is perspective view of a door.
Figure 3:
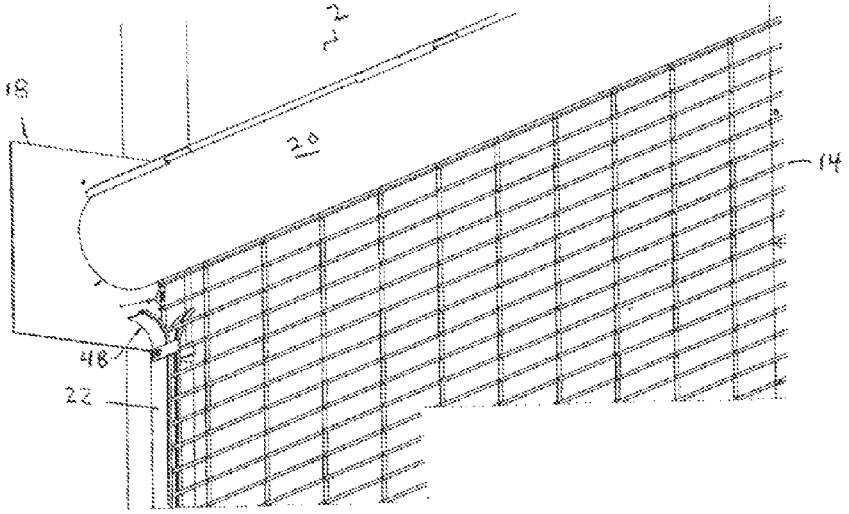
FIG. 3 is a perspective view of a portion of a door highlighting a guide assembly.
Figure 4:
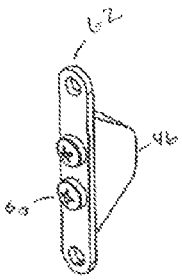
FIG. 4 is a perspective view of a bumper.
Figure 5:
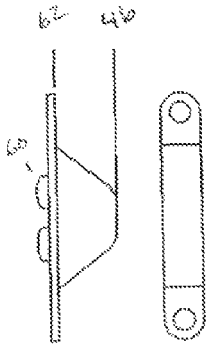
FIG. 5 is a side view of a bumper.

Turning now to FIGS. 1-3, in a preferred embodiment, an overhead vertical closure, for example, overhead coiling door 2 is operatively contained within a first and second guide assembly 4, 6, the guide assemblies fixed in known fashion to both sides of a door opening, for example, the wall or a frame member 10. The door is powered by a door operator 8.

The operator, generically identified at element 8 may be either manually powered (via, for example, push-up/pull-down, a hand chain, or a hand crank) or motor powered, and comprises a counterbalance shaft 12 upon which the closure curtain 14 winds and unwinds.

The counterbalance shaft 12 supports the closure curtain 14 and assists in the operation. Such assistance is, for example, provided by a counterbalance tensioner, for example, a torsion spring, generically identified as element 16. A bracket 18 is mounted, for example, to each guide assembly 4, 6 and supports the counterbalance shaft 12 and closure curtain 14. A protective hood 20 encloses the closure curtain 14 and provides both weather resistance at the head of the door 2 and helps to keep the brackets 18 rigid.

The first and second guide assemblies 4, 6 support the weight of the closure curtain 14. They may be, for example, a two piece extruded aluminum side rail assembly 22 (FIG. 3), or a structural steel assembly 24 (FIG. 2). Optionally, guide assemblies terminate in a bell mouth 48.

The closure curtain 14 has a top, a bottom, and an articulated central section between the top and the bottom, for example, an open pattern curtain design (FIG. 1), for example a rolling grille, or interlock solid slats (FIG. 2). A bottom bar 26 is attached to the bottom of the closure curtain 14 and optionally comprises a lock mechanism 28.

Turning to FIGS. 4-7, a plurality of bumpers 40 are fastened to a closure curtain side 36. Bumpers 40 are fastened with screws 60 through an end link 62 of closure curtain 14 so as to operatively travel within the guide assemblies 4, 6. Nut 42 and bolt 44 attach the end link 62 to a closure curtain rod 64.

Bumpers 40 comprise an engagement part 46 comprising two extending sides 52 which extend meet a vertical side 50. The engagement part 46 operatively engages the guide assemblies 4, 6. The geometry of the bumper 40 may be any shape that allows the bumper 40 to travel within the guide assemblies 6, 8 without binding.

Figure 6:
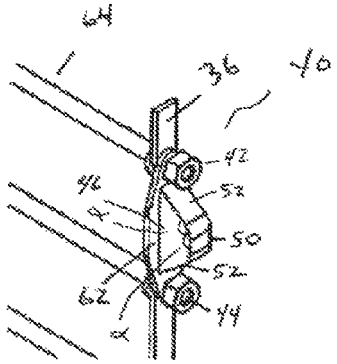
FIG. 6 is a perspective view of a bumper attached to a curtain.

Shown in FIG. 6, in a first preferred embodiment, the geometry of the bumper 40 is such that the vertical side 50 and the extending sides 52 meet in one or more obtuse angles $\alpha$, for example, forming a multi-planar surface. For example, bumper 40 comprises a trapezoidal shaped first part 46 extending from the end link 62.

Figure 7:
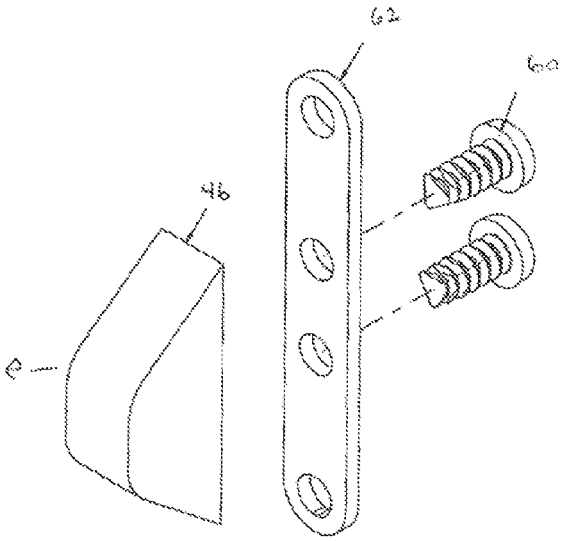
FIG. 7 is an exploded perspective view of a bumper and end link.

In a second preferred embodiment shown in FIG. 7, the geometry of the bumper 40 is such that the vertical side 50 and the extending sides 52 meet in a radius $\rho$.

The bumpers 40 are spaced to operatively keep the closure curtain 14 centered. The bumpers 40 are spaced preferably about every 4 inches to about 20 inches, most preferably, about every 12 inches along the closing curtain side 36. However, any distance between bumpers 40 that maintains effective centering is contemplated.

In a preferred embodiment, the bumpers 40 are fabricated from materials having a dry surface coefficient of friction, below that of steel on steel. For example, a dry surface coefficient of friction of less than about 0.30-0.40 Static and about 0.25-0.35 Kinetic, such as ultra high molecular weight polyethylene (UHMW).

The door 2 operates by pushing or pulling the closure curtain 14, or by manual or power rotation of the counterbalance shaft 12, for example, at a gear end 30 (FIG. 2). The opposite end 32 of the counterbalance shaft 12 applies spring tension and is equipped with, for example, a spring tensioner 34, for example, a spring adjusting wheel. As the closure curtain 14 travels within the guide assemblies 4, 6, the bumpers 40 keeps the closure curtain 14 centered between the brackets 18, prevents the closure curtain 14 and its components from rubbing against the bracket 18, and prevents metal to metal contact, increasing the useful life of the door 2.

The closure curtain 14 is attached to the counterbalance shaft 12 and rolls onto and off of the counterbalance shaft 12 as the counterbalance shaft 12 is rotated. The closure curtain 14 travels within the vertically oriented guide assemblies 4, 6, within which the bumpers 40 are contained and guided.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. An overhead closure comprising:

a closure curtain comprising a plurality of closure curtain rods operatively contained within a first and second guide assembly;

a flat closure curtain articulation enabled end link fastened at each of a first and second end to a different closure curtain rod of the plurality of closure curtain rods;

a powered door operator comprising a counterbalance shaft upon which the closure curtain winds and unwinds; a first and second bracket mounted to support the counterbalance shaft;

and a bumper fixed to and extending from a closure curtain articulating central section configured to travel within the guide assemblies;

wherein the bumper is fixed to the flat closure curtain articulation end link with a fastener that is fastened through the flat closure curtain articulation enabled end link and into the bumper.

2. The overhead closure of claim 1 wherein the bumper comprises a flat bottom and two extending sides which extend to meet a bumper vertical side.

3. The overhead closure of claim 2 wherein the vertical side and at least one extending side form one or more obtuse angles.

4. The overhead closure of claim 2 wherein the vertical side and at least one extending side form a radius.

5. The overhead closure of claim 1 wherein a plurality of bumpers are spaced to operatively keep the closure curtain centered between the brackets.

6. The overhead closure of claim 1 wherein a plurality of bumpers are spaced about every 4 inches to about every 20 inches.

7. The overhead closure of claim 1 wherein a plurality of bumpers are spaced about every 12 inches.

8. The overhead closure of claim 1 wherein the bumper has a dry surface coefficient of friction below about 0.30-0.40 Static and about 0.25-0.35 Kinetic.

9. The overhead closure of claim 1 wherein the bumper comprises ultra-high molecular weight polyethylene.

10. The overhead closure of claim 1 wherein the bumper has a trapezoidal geometry.

11. The coiling closure of claim 1 wherein the closure curtain comprises an open pattern curtain design.

12. The overhead closure of claim 1 wherein each end of the flat end link are not offset to one another.

13. A coiling closure curtain comprising:

a top;

a bottom;

an articulating central section between the top and bottom comprising a plurality of closure curtain rods;

a flat closure curtain articulation enabled end link fastened at each of a first and second end to a different closure curtain rod of the plurality of closure curtain rods;

and a bumper fixed to and extending from a closure curtain articulating central section configured to travel within the guide assemblies;

wherein the bumper is fixed to the flat closure curtain articulation end link with a fastener that is fastened through the flat closure curtain articulation enabled end link and into the bumper.

14. The coiling closure curtain of claim 13 wherein the bumper comprises a flat bottom and two extending sides which extend to meet a bumper vertical side.

15. The overhead closure curtain of claim 14 wherein the vertical side and at least one extending side form one or more obtuse angles.

16. The overhead closure curtain of claim 14 wherein the vertical side and at least one extending side form a radius.

17. The overhead closure curtain of claim 13 wherein the the bumper has a dry surface coefficient of friction below about 0.30-0.40 Static and about 0.25-0.35 Kinetic.

18. The coiling closure of claim 13 wherein the articulating central section comprises an open pattern curtain design.

19. The coiling closure curtain of claim 13 wherein each end of the flat end link are not offset to one another.

20. A method of opening and closing an overhead ceiling door comprising the step of applying power to a counterbalance shaft to wind and unwind a coiling door about a shaft, wherein the coiling door comprises a plurality of closure curtain rods and is operatively contained within a first and second guide assembly;

a flat closure curtain articulation enabled end link fastened at each of a first and second end to a different closure curtain rod of the plurality of closure curtain rods;

a bumper is fixed to and extends from the coiling door, the bumper configured to travel within the first and second guide assemblies;

the bumper is fixed to the flat closure curtain articulation end link with a fastener that is fastened through the flat closure curtain articulation enabled end link and into the bumper;

wherein the bumper comprises two extending sides which extend to meet a bumper vertical side.

* * * * *